United States Patent [19]

Woodford, II

[11] 4,108,253

[45] Aug. 22, 1978

[54] ELEVATABLE OPERATOR'S COMPARTMENT HAVING A DRILL STEEL GUIDE FOR A MINE DRILLING MACHINE

[75] Inventor: Clarence H. Woodford, II, Fairmont, W. Va.

[73] Assignee: Mining Equipment Division, FMC Corporation, Fairmont, W. Va.

[21] Appl. No.: 828,154

[22] Filed: Aug. 26, 1977

[51] Int. Cl.[2] ..... E21C 11/02

[52] U.S. Cl. ..... 173/23; 61/63; 173/38; 175/219; 175/220

[58] Field of Search ..... 61/45 R, 45 B, 63; 173/22, 23, 27, 28, 38, 43, 44; 180/77 MC, 89.12; 175/219, 220; 280/748, 756; 299/12

[56] References Cited

U.S. PATENT DOCUMENTS

| | | | |
|---|---|---|---|
| 2,423,787 | 7/1947 | Mosena et al. | 175/219 X |
| 2,811,335 | 10/1957 | Fletcher et al. | 173/23 |
| 3,366,185 | 1/1968 | Heise | 173/28 |
| 3,529,680 | 9/1970 | Nardone et al. | 173/35 |
| 3,768,574 | 10/1973 | Long | 173/23 |
| 3,865,197 | 2/1975 | McCormick | 173/23 |
| 3,893,520 | 7/1975 | McCormick | 175/219 X |
| 4,022,026 | 5/1977 | Childress | 61/45 R X |
| 4,026,118 | 5/1977 | McCay | 61/63 |
| 4,050,259 | 9/1977 | Childress | 61/45 R X |
| 4,065,167 | 12/1977 | Wright | 175/219 X |

FOREIGN PATENT DOCUMENTS

| | | | |
|---|---|---|---|
| 1,149,478 | 4/1969 | United Kingdom | 175/220 |

*Primary Examiner*—Lawrence J. Staab

*Attorney, Agent, or Firm*—Stanley J. Price, Jr.; John M. Adams

[57] ABSTRACT

A drill boom is connected at its rear end portion to a mobile body and supports at its front end portion a drill pot for rotating a drill steel. The drill boom raises the drill pot along a predetermined straight-line path to advance the rotating drill steel into the mine roof to form a bore hole for insertion of a roof bolt assembly. An operator's compartment is slidably mounted on the front end of the mobile body laterally of the drill boom. A hydraulic cylinder positioned on the mobile body raises the operator's compartment along a plane aligned with the plane of movement of the drill pot. A protective canopy overlies and is movable with the operator's compartment. A drill steel guide is secured to the canopy and includes movable guide portions that extend into surrounding relation with the drill steel. The drill steel guide is elevated with the canopy to a position adjacent the mine roof. The guide maintains the drill steel along the predetermined straight-line path as drill steel advances into the mine roof by upward movement of the drill boom.

10 Claims, 6 Drawing Figures

ELEVATABLE OPERATOR'S COMPARTMENT HAVING A DRILL STEEL GUIDE FOR A MINE DRILLING MACHINE

BACKGROUND OF THE INVENTION

1. Field of the Invention

This invention relates to a boom type mine drilling machine for drilling holes and installing roof bolts in a mine roof, and more particularly to an operator's compartment protected by an overhead canopy where the operator's compartment is movable upwardly and downwardly along a predetermined straight-line path and supports a drill steel guide for maintaining a drill steel along said path.

2. Background of the Invention

In underground mining, it is the present practice to support the roof of a mine with roof bolts and, in certain instances, with horizontal timbers or metallic tie members secured to the surface of the roof by a plurality of roof bolts that extend through predrilled holes in the timbers or tie members. Also, it is known to substitute the metallic tie members and timbers with a rectangular roof plate that is supported in bearing relation with the roof surface when the roof bolt is fully engaged in the bore hole. A boom supported roof drill as illustrated in U.S. Pat. Nos. 3,319,727 and 3,375,880 includes boom members that support the drill pot for movement of the drill steel in a straight line as it is advanced into the rock strata. The boom is positioned on a self-propelled vehicle that is movable to preselected locations in the mine entry for installing roof bolts in accordance with a preselected pattern that provides the optimum support of the overhead roof.

The mobile boom-type drilling machines include a linkage mechanism for moving the drill pot mounted on the front end portion of the drill boom in a vertical linear path. Means is also provided for mechanically varying the linkage to permit the drill to move in a path at an angle and in a vertical plane. In this manner, fore and aft angular adjustment for the drill steel is made and it is possible to change the angular path of the drill from a straight line vertical path to a vertical fore or aft angular path relative to the mining machine.

It is the conventional practice to stabilize the machine during roof drilling and bolting operations particularly for machines mounted on rubber tires. This is accomplished by stabilizing jacks which are lowered to engage the mine floor and transfer the weight of the machine from the wheels to the jacks. Because the front end of the machine is raised when the jacks are lowered into engagement with the ground, the boom linkage is adjusted to support the drill pot in a fore position at a preselected angle from the vertical to the ground. Thus, when the jacks are engaged the machine body is raised to move the drill pot aft and align the drill steel for upward movement along a vertical linear path.

When the bolt holes are being drilled in relatively hard materials substantial problems are encountered in aligning the drill steel with the axis of the bore hole during the drilling operation, especially where the bolt holes are a substantial depth. It has been found extremely difficult to maintain the drill steel aligned with the bore hole throughout the entire drilling operation. When one drills in hard material, frequently the drill steel will penetrate the hard material and be deflected slightly or tilt relative to the vertical axis. Continued vertical drilling when the drill steel is tilted or deflected and not aligned with the bore hole causes the drill steel to rub against the sidewall of the bore hole, especially at a location adjacent the roof surface. Under certain circumstances, the rubbing of the drill steel on the collar of the hole causes the drill steel through friction to overheat and break. As is well known, this frictional rubbing can also cause a fire hazard at the mine face in gaseous mines. The rubbing of the drill steel against the sides of the bore hole also absorbs a substantial amount of the thrust energy imparted to the drill and reduces the drilling efficiency.

To maintain axial alignment of the drill steel with the bore hole it is the conventional practice for the operator, particularly in "spotting" the drill head to start the bore hole, to steady the drill steel with his hand. The operator continues to hold the drill steel as it advances into the mine roof to maintain the drill steel in a vertical axis for drilling a bore hole in a straight line. Thus the operator uses his hand to align the drill steel with the axis of the bore hole when the drill steel deflects and rubs against the sidewall of the bore hole. Such a practice subjects the drill operator to substantial risk of injury and should be avoided.

Centralizers for guiding movement of a drill steel along a predetermined straight-line path during starting of the bore hole are known in the art such as illustrated in the following U.S. Pat. Nos.: 2,350,658, 2,350,659, 2,350,660, 2,350,661, 2,365,680, 2,365,681, 2,365,682, 2,365,683, 2,365,684, 2,365,685, 2,365,686, 2,365,687, 2,394,806.

These references relate generally to drill steel centralizers for a hammer type face drilling machine where a pair of cooperating centralizer arms are mounted on a guide and include guide portions for engaging the body of the drill steel. The arms center the drill steel during starting of the drill hole. Once the drill hole is started the guide portions are released from engagement with the drill steel.

U.S. Pat. No. 3,842,610 discloses a mine drilling machine having a boom supported drill chuck assembly with a split guide collar for holding upright a rock drill. The guide collar is supported by the drill chuck assembly and is movable into and out of surrounding relation with the rock drill positioned in the chuck. The guide collar moves upwardly with the assembly. U.S. patent application, Ser. No. 793,723, filed May 4, 1977, discloses a separate boom for a drill guide that maintains the drill steel in a vertical linear path as it drills the bore hole. The above application also includes a protective canopy mounted on the drill boom for providing the operator with overhead protection.

Operator protective devices, such as overhead canopies, are conventionally used with mine roof drilling and bolting machines. U.S. Pat. No. 3,893,520 discloses a canopy assembly for a dual boom drill. The dual boom drill of U.S. Pat. No. 3,768,574 features a canopy that is raised and lowered relative to a pair of drill booms. The canopy overlies a platform upon which an operator may be situated. The canopy and platform may be raised and lowered as a unit or independently of one another.

While it has been suggested by the prior art systems to provide drill steel guides for boom type mining machines, there is need for a boom type mining machine that includes a drill steel guide and means for supporting the drill operator on a movable platform which provides the operator with overhead protection.

SUMMARY OF THE INVENTION

In accordance with the present invention there is provided a mobile drilling machine that includes a mobile body having a front end portion. A drill boom has a front end portion and a rear end portion. The drill boom rear end portion is secured to the mobile body to permit upward and downward movement of the front end portion along a predetermined straight-line path. A drill pot is secured to the drill boom front end portion and is adapted to move a drill steel along the predetermined straight-line path. An operator's compartment is mounted for slidable movement upwardly and downwardly relative to the mobile body front end portion. A drill steel guide is secured to the operator's compartment and is operable to maintain the drill steel aligned with the predetermined straight-line path. The operator's compartment is operable to move the drill steel guide in a plane aligned with the predetermined straight-line path.

The drilling machine mobile body is mounted on wheel members, such as rubber tires, that are conventionally propelled to move the body portion to selected locations in the mine for drilling bolt holes and installing roof bolts in the mine roof. When the mobile body has been advanced to a position underlying a preselected location in the mine roof for the insertion of a roof bolt, stabilizing mechanisms, such as stabilizing jacks, are actuated to stabilize the body portion during the roof drilling and roof bolt installation operations. Preferably, a pair of stabilizing jacks are secured to the front end portion of the mobile body.

The stabilizing jacks are operable upon actuation to move to a lowered position and engage the ground. After drilling and prior to advancing the mobile body portion to the next drilling location, the stabilizing jacks are moved to a raised position disengaged from the ground. The jacks are maintained in the raised position during tramming of the machine.

The drill boom is arranged to move the drill pot along a straight-line path inclined from a vertical position relative to the ground when the stabilizing jacks are in the raised position. When the stabilizing jacks are actuated to move to the lowered position, the mobile body is raised and the drill boom is moved to position the drill pot for movement along a vertical, linear path relative to the ground.

The drill steel guide is secured to the operator's compartment in a position to guide the drill steel along a straight-line path inclined from the vertical when the stabilizing jacks are disengaged from the ground. This is the position of the drill steel guide during tramming of the mobile body. When the stabilizing jacks are lowered to engage the ground, the operator's compartment is tilted upwardly so that the drill steel guide is positioned for movement through a vertical linear path. This is the position of the drill steel guide during drilling and bolting operations.

The drill steel guide is preferably secured to a canopy assembly that overlies the operator's compartment to protect the operator from debris dislodged from the mine roof during drilling and bolting operations. The drill steel guide includes a pair of guide portions that are movable to a guide position surrounding the drill steel. In the guide position the guide portions maintain the drill steel aligned with the predetermined straight-line path of movement the drill steel is to follow.

The drill steel guide is preferably secured to the top of the protective canopy which is supported by the frame of the operator's compartment. The frame is slidably mounted on the front end of the mobile body for movement upwardly and downwardly in a plane aligned with the plane of movement of the drill pot. Thus when the drill steel guide is moved to a preselected fixed position the drill steel will be guided by the drill steel guide along the predetermined straight-line path as it advances into the mine roof.

The protective canopy extends rearwardly to a position overlying the front end of the mobile body. An extensible mechanism, such as a hydraulic cylinder, is securely mounted at its base on the mobile body. The upper end portion of the extensible mechanism is secured to the canopy so that upon actuation of the mechanism the canopy and the entire operator's compartment is raised and lowered. In this manner the operator is positioned to observe and control the drilling and bolting operations while being protected by the overhead canopy from falling debris.

During tramming of the mobile body and when the stabilizing jacks are raised from the ground, the operator's compartment is supported on the front of the mobile body for movement in a linear plane angled from the vertical. However, when the stabilizing jacks are lowered to engage the ground, the front end portion of the mobile body is raised. This removes the weight of the body portion from the wheels and transfers it to the stabilizing jacks so that the mobile body portion is stabilized for the drilling and bolting operations. With the jacks down the operator's compartment is tilted so that when the canopy is raised the drill steel guide moves in a plane aligned with the plane of movement of the drill pot. The plane of movement is vertical with respect to the ground. Thus, the drill steel guide secured to the operator's compartment maintains the drill steel in a vertical linear path as the drill boom raises and lowers the drill pot.

Accordingly, the principal object of the present invention is to provide a boom type mine drilling machine that includes an operator's compartment covered by a protective canopy and slidably mounted on the front of the drilling machine to move upwardly and downwardly along a straight-line path so that a drill steel guide mounted on the canopy moves along a predetermined straight-line path and maintains the drill steel aligned with the predetermined straight-line path as the drill boom is raised and lowered.

Another object of the present invention is to provide an operator's compartment that is mounted for vertical linear movement on the front of a mine drilling machine and includes a drill steel guide which is raised and lowered with the operator's compartment to a preselected elevation for guiding movement of a drill steel along a vertical linear path.

These and other objects of the present invention will be more completely disclosed and described in the following specification, the accompanying drawings and the appended claims.

DESCRIPTION OF THE PREFERRED EMBODIMENT

Figure 1:
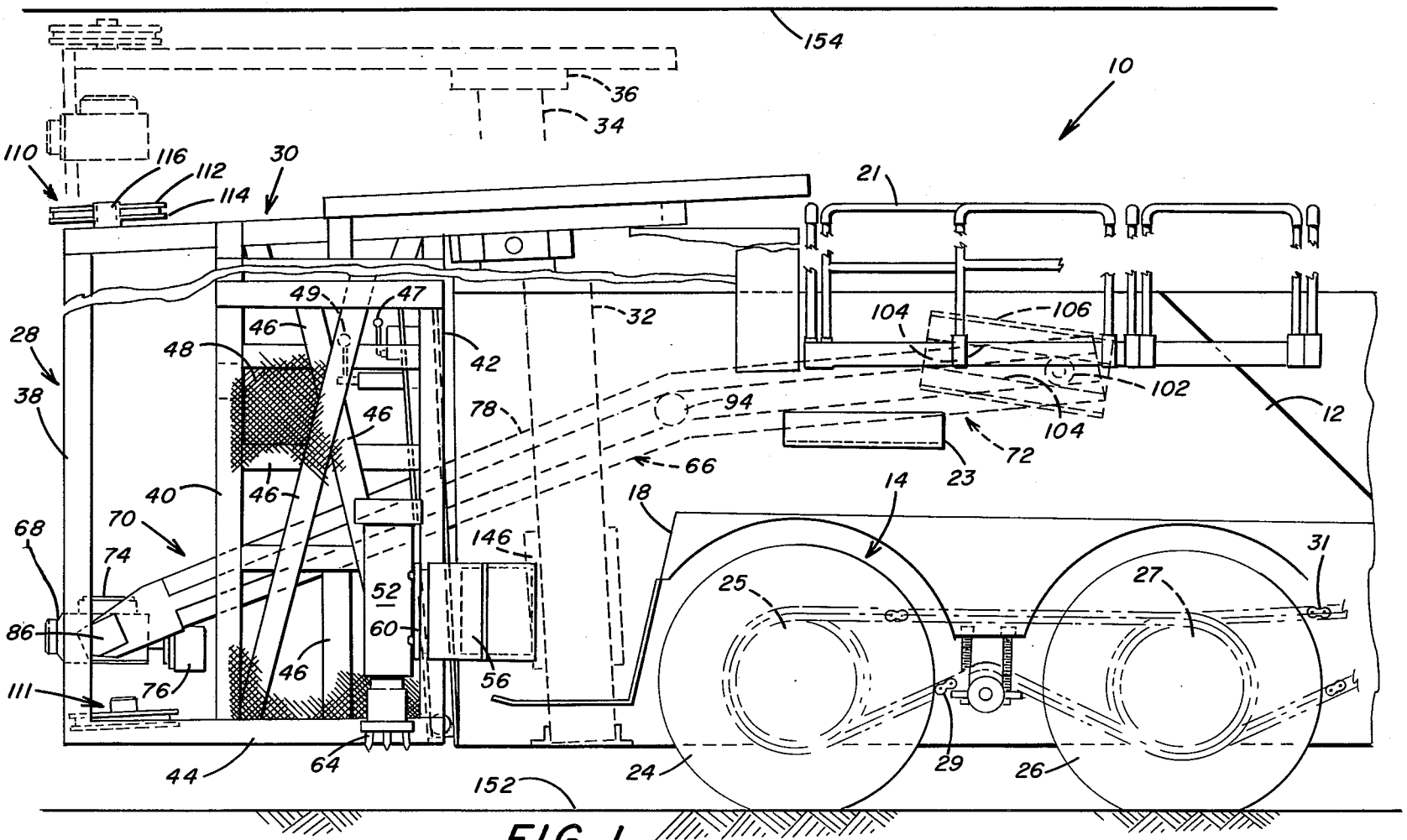
FIG. 1 is a fragmentary view in side elevation of a boom type mine drilling machine, illustrating an operator's compartment protected by an overhead canopy and movably mounted on the front of the machine mobile body to position a drill guide for guiding a drill steel along a predetermined straight-line path.

Referring to the drawings, there is illustrated a mine drilling machine generally designated by the numeral 10 that includes a mobile body 12 mounted upon a wheeled suspension generally designated by the numeral 14. The mobile body 12 comprises a chassis having spaced, parallel side plates 16 with a fender 18 at front end portion 20 of the mobile body. A fender (not shown) is provided at the rear end portion of the mobile body and a floor plate 22 extends between the side plates 16 and the front and rear fenders. The various devices for operating the drilling machine such as the controller, motor, hydraulic pump, oil tank and the like are supported by the floor plate. A catwalk 19 on the mobile body extends substantially around the drill boom and is enclosed by a railing 21. The catwalk 19 is accessible by a step 23 positioned above the fender 18.

The wheeled suspension 14 includes a pair of front wheels 24 and a pair of rear wheels 26 that are connected to the body portion 12 by axles 25 and 27. The wheels 24 and 26 are driven by movement of chain 29 around sprockets on axles 25 and 27. The axle 27 is rotated by a chain 31 which is driven by a traction motor (not shown). With this arrangement the mine drilling machine 10 is propelled through the mine and further details of the wheeled suspension 14 and drive means are more completely illustrated and described in U.S. Pat. No. 3,252,525 which is incorporated herein by reference.

An operator's compartment generally designated by the numeral 28 in FIG. 1 is mounted for slidable movement upwardly and downwardly relative to the mobile body 12. The operator's compartment includes an overhead protective canopy 30 under which the drill operator is positioned at all times to protect the drill operator from debris falling from the mine roof. The canopy 30 extends rearwardly and overlies the mobile body 12. The canopy 30 comprises a plurality of transverse and longitudinal support members covered by an expanded metal screen 33. An extensible mechanism, such as a hydraulic cylinder 32, is securely mounted on the floor plate 22. An extensible piston rod 34 is positioned within the cylinder 32 and is connected at its upper end portion by a bracket 36 to the canopy 30. Actuation of the cylinder 32 extends the piston rod 34 to raise the canopy and the entire operator's compartment 28 relative to the mobile body 12.

Figure 3:
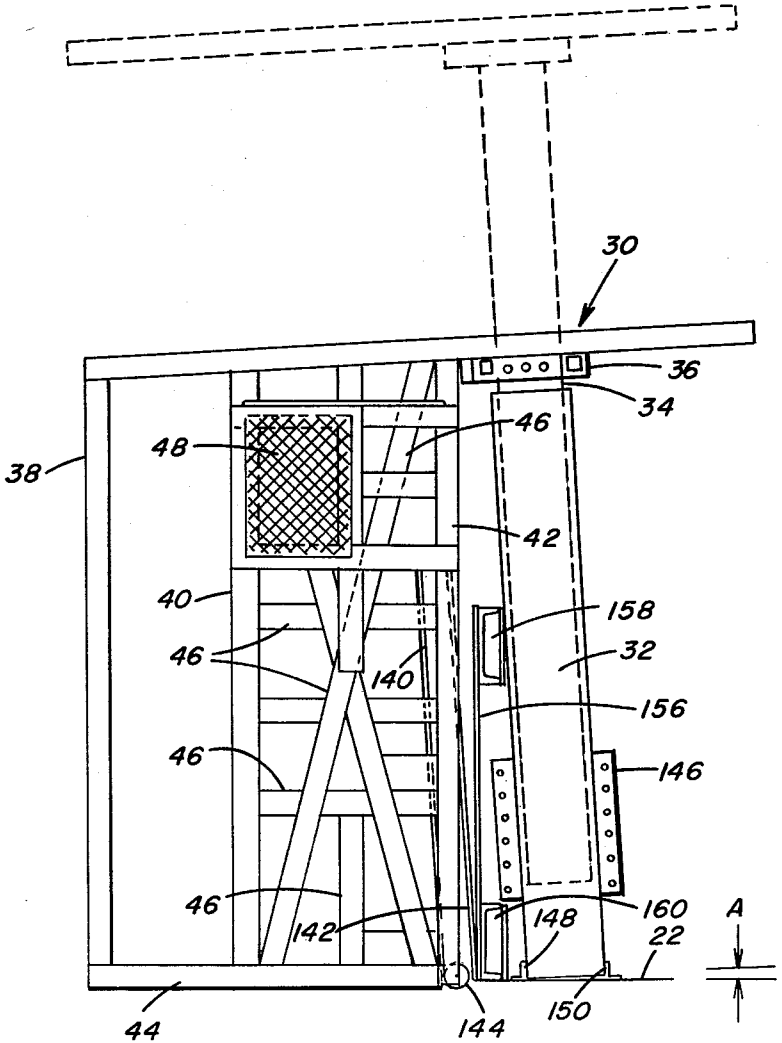
FIG. 3 is a view in side elevation of the operator's compartment, illustrating a hydraulic cylinder mounted on the machine mobile body for raising and lowering the canopy and the operator's compartment with the raised position shown in phantom.

A plurality of vertical support members 38, 40 and 42 extend downwardly from the canopy 30 and are secured to a substantially horizontally extending frame 44 that forms the platform upon which the drill operator stands. The support members 40 and 42 are connected by a plurality of vertical, horizontal and diagonal brace members 46. The brace members 46 form an enclosed area for the drill operator to stand. This area may be covered by an expanded metal screen 48, part of which is shown in FIGS. 1 and 3. Operator controls 47 and 49 are provided in this enclosed area. With this arrangement the drill operator is protected overhead and laterally during the roof drilling and bolting operations.

Figure 5:
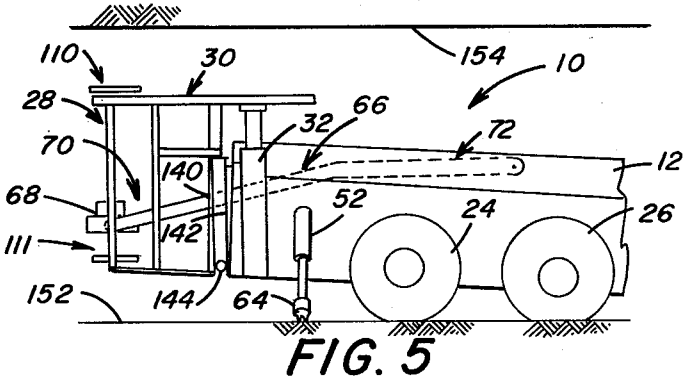
FIG. 5 is a view similar to FIG. 4, illustrating the stabilizing jack engaged with the ground and the drill steel guide raised with the operator's compartment in a linear vertical path.
Figure 6:
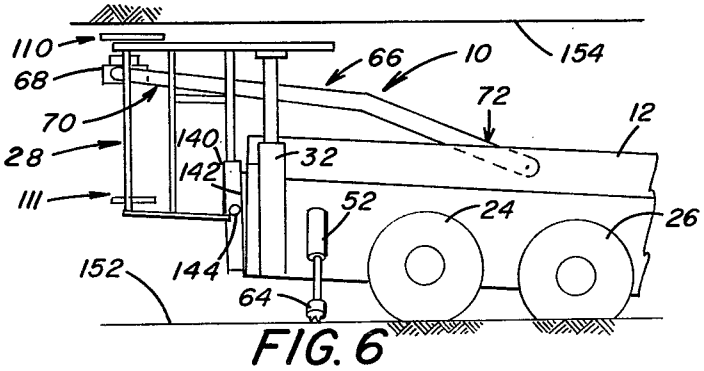
FIG. 6 is a view similar to FIG. 5, illustrating the drill steel guide raised vertically to a position adjacent the mine roof with the drill boom raised.

Positioned laterally of the operator's compartment 28 and extending forwardly from the fender 18 are a pair of extensible mechanisms, such as hydraulically operated stabilizer jacks 52 and 54. Arm members 56 and 58 are secured to and extend forwardly from the fender 18 of the jacks 52 and 54 and include brackets 60 and 62 that are bolted to the cylindrical portion of the jacks 52 and 54. The hydraulic jacks each include a base portion 64 that is movable upon actuation of a jack from a raised position as illustrated in FIG. 1 to a lowered position engaged with the ground, as illustrated in FIGS. 5 and 6. In the lowered position the jacks 52 and 54 exert an upward force upon the body mobile 12 to transfer the weight from the rubber tired wheels 24 and 26 to the jacks. With this arrangement the mobile body 12 is stabilized for roof drilling and bolting operations.

A drill boom generally designated by the numeral 66 extends longitudinally over the front end portion 20 of the mobile body 12 and projects outwardly therefrom to carry a drill pot 68 at the front end portion 70 of drill boom 66. A rear end portion 72 of boom 66 is mounted to facilitate upward and downward movement of the front end portion 70 along a predetermined straight-line path. The drill pot 68 includes a rotatable chuck 74, as illustrated in FIG. 1, that is driven by a motor 76. A drill steel (not shown) is retained in the rotatable chuck 74. The drill steel includes a drill head arranged to advance into the mine roof as the drill pot 68 is raised along a predetermined straight-line path. A single motor such as a rotary drill motor may be utilized or a percussion motor (not shown) may be utilized in combination with a rotary motor for imparting both rotation and percussion to the drill steel as it is advanced upwardly into the mine roof.

The drill boom 66 includes a pair of boom arms 78 held in spaced, parallel relation by an inner connecting web generally designated by the numeral 80 that includes arms 82 and 84. The front end portions of the boom arms 78 and the arms 82 and 84 of web 80 are pivotally connected by trunnions 86 to the drill pot 68. During upward movement, the drill boom 66 constantly changes its angular position, and it is therefore necessary to provide means to maintain the drill pot level so that the drill steel extends vertically. This is accomplished by connecting the arms 82 and 84 at their rearward end portions to a pivot link generally designated by the numeral 88.

The pivot link 88 includes a pair of arms 90 and 92 that are pivotally connected at their rear end portions to boom member 66 by a pivot pin 94 that extends through the arms 82, 90 and 84, 92 respectively. The front end portions of the link arms 90 and 92 are connected by a pivot pin 96 that is rotatably supported by a clevis 98 that extends rearwardly from the upper portion of a support frame 100 that extends upwardly from the mobile body 12. The rear end portions of the boom arms 78 rotatably support rollers 102, one of which is shown in FIG. 1. The rollers 102 are positioned on slide surfaces 104 of a slide block 106 that is rigidly supported in a conventionally known manner on the mobile body 12. With this arrangement the rear end portion 72 of the drill boom 66 is mounted for rectilinear movement on the mobile body 12.

Figure 2:
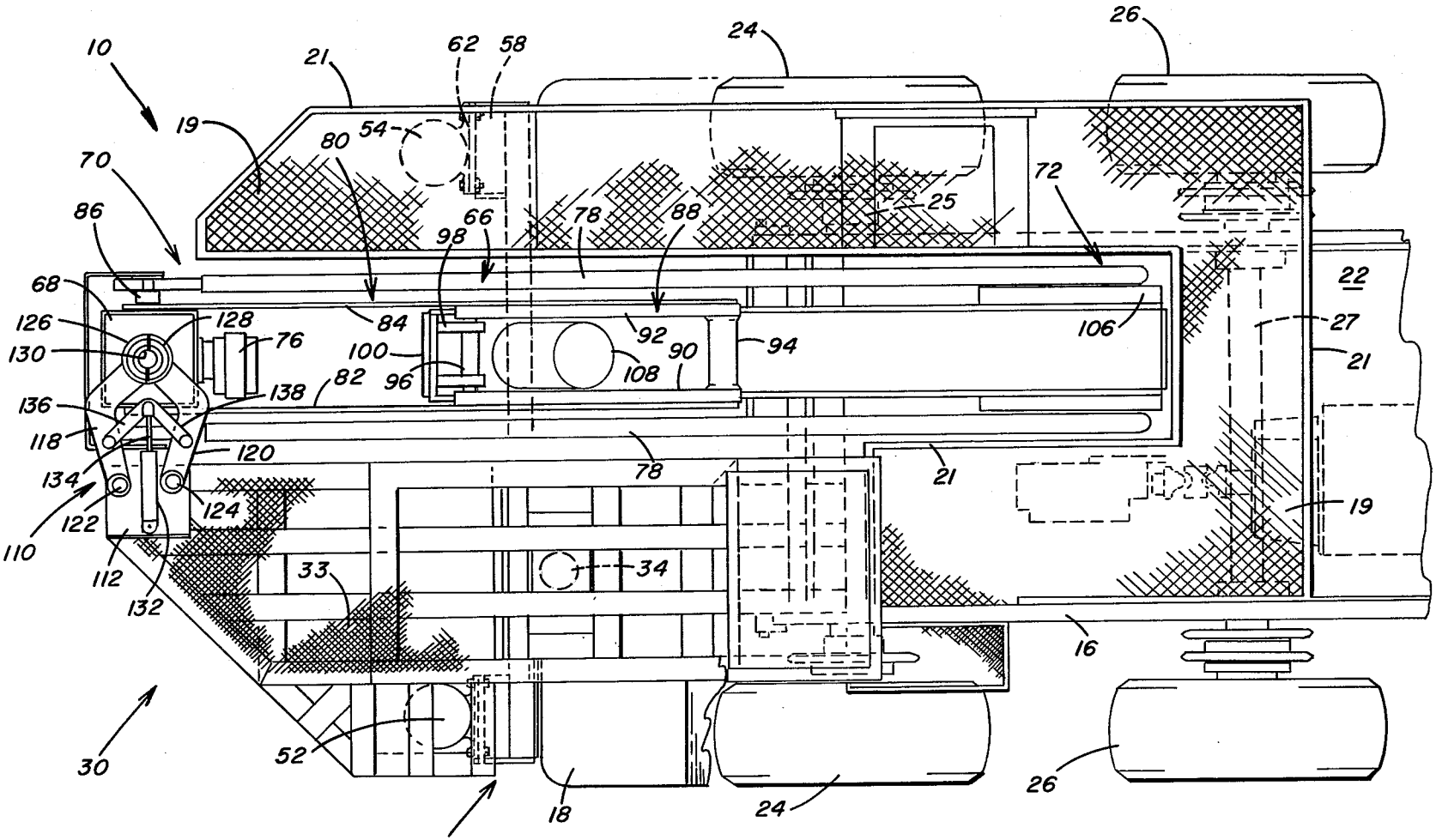
FIG. 2 is a top plan view of the mine drilling machine shown in FIG. 1, illustrating a drill steel guide extending outwardly from the protective canopy and overlying a drill pot supported by a drill boom.

In order to raise and lower the drill boom 66, an elevating device 108, illustrated in FIG. 2, such as a hydraulically operated lift jack, is utilized and includes a piston rod (not shown) pivotally connected to the support frame 100 and a base portion pivotally connected to the connecting web arms 90 and 92. By supplying fluid under pressure to the base portion of the lift jack 108, the piston rod is extended to raise the link arms 90 and 92 about the pivot pin 96. The upward pivotal movement of the link arms 90 and 92 raises the front end portion 70 of boom member 66 together with the drill pot 68 along a predetermined straight-line path as the rear end portion 72 moves rectilinearly on the slide block 106.

When the stabilizer jacks 52 and 54 are in a raised position, the drill pot 68 is angled in a fore position by the link 88. In this position, actuation of the lift jack 108 moves the drill pot 68 upwardly and downwardly along a straight-line path at a preselected angle from the vertical. When the stabilizing jacks 52 and 54 are lowered, the front end portion 20 of the mobile body is raised, and the drill pot 68 is angularly adjusted so that a drill steel in the drill pot will follow a vertical linear path.

The upward and downward movement of a drill steel positioned in the chuck 74 of the drill pot 68 is maintained along a predetermined straight-line path by a centralizer such as the drill guide assembly generally designated by the numeral 110. The drill guide 110 is secured to a selective position on the operator's compartment and preferably at a position on the upper surface of the protective canopy 30 for guiding upward movement of the drill steel into the mine roof. A second drill guide 111 may be secured to the horizontal frame 44 for guiding downward movement of the drill steel into the mine floor. The drill guide 110 in FIG. 2 is positioned forwardly on the upper surface of the frame members that comprise the protective canopy 30. The protective canopy 30 is positioned laterally of the drill boom 66, and the drill guide 110 extends laterally from the canopy into overlying relationship with the drill pot 68.

The drill guide 110 is supported by a pair of overlying plate members 112 and 114 that are secured by a cylindrical member 116 to the protective canopy 30. The vertical axes of the cylindrical member 116 is angled forwardly a preselected number of degrees from a vertical position. When the stabilizing jacks 52 and 54 are lowered, the angular position of the cylindrical member 116 is adjusted aft to where its vertical axis is aligned with a plane extending vertical to the ground. A pair of drill guide members 118 and 120 are pivotally connected by pivot pins 122 and 124 to the plate members 112 and 114 for movement toward and away from each other into and out of a drill guide position surrounding the drill steel. The opposite end portion of guide members 118 and 120 include guide portions 126 and 128. The guide portions 126 and 128 have a semicircular configuration, and when positioned in abutting relation form a bore 130 through which the drill steel extends.

A piston cylinder assembly 132 is secured to the plate members 112 and 114 and includes a piston rod 134 connected at its end portion to levers 136 and 138 that are pivotally connected intermediate the ends of the guide members 118 and 120 respectively. With this arrangement upon actuation of the piston cylinder assembly 132 to extend the piston rod 134 to the position illustrated in FIG. 2, the levers 136 and 138 are pivoted to move the guide portions 126 and 128 into abutting relation surrounding the drill steel extending upwardly from the drill pot 68. Similarly, retraction of the piston rod 134 pivots the guide members 118 and 120 so that the guide portions 126 and 128 are moved away from each other. The drill guide 111 positioned on the horitontal frame 44 at the bottom of the operator's compartment has a construction and operation identical to the drill guide illustrated in FIG. 2 to facilitate guiding the drill steel along a predetermined straight-line path for drilling in the mine floor. The drill guides 110 and 111 are normally maintained in a fore position on the compartment 28 as shown in FIG. 1.

The protective canopy 20 is supported on the mobile body portion 12 for upward and downward movement along a predetermined straight-line path by a pair of support members 140 that are secured at their lower end portions in spaced relation to the front end portion 20 of the mobile body 12. The support members 140 are inclined forwardly from the mobile body and each includes a guideway 142. Follower members 144 are secured to the horizontal frame 44 and are arranged for movement in the guideways 142 respectively.

As illustrated in greater detail in FIG. 3, the hydraulic cylinder 32 includes a bracket 146 that is suitably bolted to the mobile body 12. The base portion of the hydraulic cylinder is supported on the floor plate 22 by flanged members 148 and 150 in a position so that the cylinder 32 tilts forward at an angle A, for example 3°. A front wall 156 extends upwardly from the floor plate 22 and supports upper and lower brace members 158 and 160. The brace member 158 supports cylinder 32 in its tilted position. With this arrangement when the stabilizing jacks 52 and 54 are lowered the machine body is raised so that the angular position of the cylinder 32 is adjusted aft to a vertical position, as illustrated in FIG. 5. In this position the cylinder 32 is operable to raise the canopy 30 through a vertical linear path.

Figure 4:
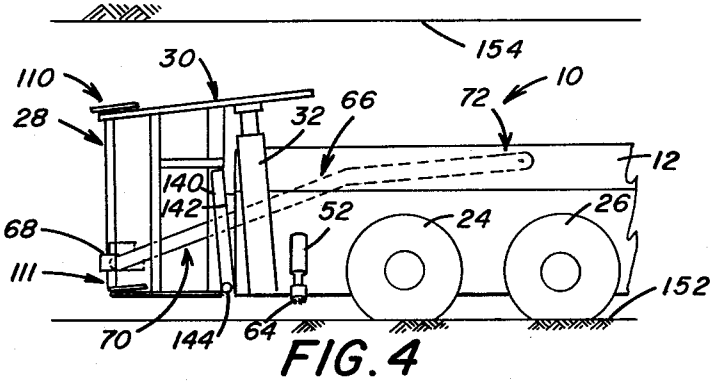
FIG. 4 is a schematic representation of the mine drilling machine of the present invention, illustrating the operator's compartment and stabilizing jack in a tramming position.

In operation, the mining machine 10 is maneuvered through the mine as illustrated in FIG. 4 on the mine floor 152 to a position where the drill pot 68 underlies the location of the mine roof 154 where a bore hole is to be drilled for installation of a roof bolt. During tramming of the mining machine 10, the stabilizing jacks 52 and 54 are in a raised position and the hydraulic cylinder 32 maintains the canopy 30 in a lowered position to provide clearance between the top of the canopy and the mine roof. Once the drilling machine has reached the location in the mine where the drilling operation is to be conducted, the stabilizing jacks 52 and 54 are extended into ground engaging relationship, as illustrated in FIG. 5.

With the jacks lowered the operator's compartment 28 is tilted aft, for example 3°, and the weight of the machine is transferred to the jacks to stabilize the machine for drilling. Also, the support members 140 are moved to a position where the guideways 142 extend along a vertical linear path. In this manner the drill guides 110 and 111 are positioned for maintaining the drill steel along a vertical linear path. With the mobile body portion 12 stabilized on the ground, as illustrated in FIG. 5, the hydraulic cylinder 32 is actuated to raise the operator's compartment 28 vertically upwardly to a position where the canopy 30 and the drill guide 110 is closely adjacent the mine roof 154 for roof drilling.

When the drill guide 110 and canopy 30 are raised to the position illustrated in FIG. 6 the lift jack 108 is actuated to raise the drill boom front end portion 70 through a vertical plane. The plane of movement of the drill pot 68 is aligned with the plane of movement of the operator's compartment 28, as provided by the vertical position of the cylinder 32 and movement of the follower members 144 in the guideways 142. Thus, as the drill pot is raised vertically and the drill steel advances into the mine roof, the drill guide portions 126 and 128 in a guide position maintain the drill steel along a vertical linear path. Consequently a vertical bore hole is formed in the mine roof. Further, by maintaining the drill steel along a linear vertical path, the drill steel is prevented from rubbing against the side wall of the bore hole. This helps to reduce wear of the drill steel.

During the roof drilling operation, the drill operator on the operator's compartment 28 is positioned to efficiently observe the advancement of the drill steel into the mine roof. The provision of the drill guide on the canopy eliminates the need for the operator to manually guide the drill steel into the bore hole. Furthermore, the drill operator is protected by the overhead canopy 30 during the drilling operation.

With the bore hole drilled to the desired depth in the mine roof, the drill pot 68 is lowered along a vertical linear path. The drill steel is replaced with a roof bolt assembly and the drill raised to advance the assembly into the bore hole. The drill guide 110 also serves to maintain upward movement of the roof bolt assembly along a vertical linear path. This prevents the shank of the roof bolt from rubbing the side walls of the bore hole. The bolting operation is completed by urging a bearing plate on the end of the roof bolt into abutting relation with the surface of the mine roof surrounding the opening of the bore hole. To accommodate the passage of the bearing plate into position adjacent the mine roof, the guide members 118 and 120 are moved to an open position so that the guide portions 124 and 126 are sufficiently spaced apart to permit the bearing plate to pass therebetween. When the bearing plate is in place, a preselected torque is applied to the roof bolt to place the roof bolt under tension so that it supports the mine roof. At all times during the bore drilling and roof bolt installation, the operator works beneath the safety of the overhead canopy 30.

The procedure for floor drilling is accomplished in much the same manner as above described. However, the hydraulic cylinders 32 remain retracted so that a drill guide on the horizontal frame 44 is positioned in overlying relation with the drilling location on the mine floor. The lift jack 108 is actuated to lower the drill boom 66 and move the drill pot downwardly to advance the drill steel into the mine floor.

According to the provisions of the Patent Statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A mine drilling machine comprising, a mobile body, said mobile body having a front end portion, a drill boom having a front end portion and a rear end portion, said drill boom rear end portion being secured to said mobile body to permit upward and downward movement of said drill boom front end portion along a predetermined straight-line path, a drill pot secured to said drill boom front end portion and adapted to move a drill steel along said predetermined straight-line path, an operator's compartment mounted for slidable movement upwardly and downwardly relative to said mobile body front end portion, a drill steel guide secured to said operator's compartment and operable to maintain the drill steel aligned with said predetermined straight-line path, and said operator's compartment being operable to move said drill steel guide in a plane aligned with said predetermined straight-line path.

2. A mine drilling machine as set forth in claim 1 which includes, wheel members connected to said mobile body and movable on the ground to propel said mobile body, stabilizing means secured to said mobile body front end portion for stabilizing said mobile body during drilling operation, said stabilizing means being extensible to move to a lowered position engaged with the ground and to a raised position disengaged from the ground, said drill boom arranged to move said drill pot along a straight-line path inclined from a vertical position relative to the ground with said stabilizing means in said raised position, said drill boom arranged to move said drill pot along a vertical linear path relative to the ground with said stabilizing means in said lowered position, and said drill steel guide being secured to said operator's compartment in a position to guide the drill steel along said path inclined from a vertical position when said stabilizing means is in said raised position and along said vertical linear path when said stabilizing means is in said lowered position.

3. A mine drilling machine as set forth in claim 1 in which said drill steel guide includes, guide portions adapted to surround the drill steel and maintain the drill steel aligned with said predetermined straight-line path, and said operator's compartment being slidably supported on said mobile body front end portion to move upwardly and downwardly in a plane so that said guide portions move along said predetermined straight-line path of said drill pot.

4. A mine drilling machine as set forth in claim 1 which includes, said drill boom extending forwardly of said mobile body front end portion, said operator's compartment being slidably mounted on said mobile body front end portion laterally of said drill boom, extensible means positioned on said mobile body and connected to said operator's compartment for raising and lowering said operator's compartment relative to said mobile body and laterally of said drill boom, said drill steel guide having a pair of elongated guide portions, and said guide portions arranged to extend from said operator's compartment into surrounding relation with the drill steel to maintain said drill steel aligned with said predetermined straight-line path as the drill boom front end portion moves upwardly and downwardly.

5. A mine drilling machine as set forth in claim 1 which includes, said operator's compartment including a substantially vertically extending frame extending forwardly from said mobile body front end portion adjacent to said drill boom, and said drill steel guide being secured to said frame at a preselected elevation to facilitate guiding the drill steel upwardly and downwardly along said predetermined straight-line path.

6. A mine drilling machine as set forth in claim 1 which includes, said operator's compartment including a vertically extending frame having an upper end portion and a lower end portion, a protective canopy secured to and covering said frame upper end portion and extending rearwardly in overlying relation with said mobile body front end portion, extensible means for raising and lowering said frame, said extensible means having a lower end portion mounted on said mobile body and an upper end portion secured to said frame of said protective canopy, said extensible means being operable upon actuation to move said frame to a preselected elevation relative to said mobile body along said predetermined straight-line path, said drill steel guide secured on said protective canopy for guiding the drill steel upwardly along said predetermined straight-line path, a second drill steel guide secured on said frame lower end portion for guiding the drill steel downwardly along said predetermined straight-line path, and said drill boom extending forwardly of said mobile body and laterally of said operator's compartment, said drill boom arranged to support said drill pot for movement upwardly and downwardly between said first mentioned drill steel guide and said second drill steel guide.

7. A mine drilling machine as set forth in claim 1 which includes, means for mounting said operator's compartment on said mobile body front end portion to move said drill steel guide upwardly and downwardly relative to said mobile body in a plane aligned with said predetermined straight-line path, and said drill boom including means for raising and lowering said drill boom front end portion to move said drill pot in a plane aligned with said predetermined straight-line path, said plane of movement of said drill pot being aligned with said plane of movement of said drill steel guide.

8. A mine drilling machine as set forth in claim 1 in which said operator's compartment includes, a frame having an upper end portion and a lower end portion, a plurality of brace members extending between and connecting said upper and lower end portions, said lower end portion being slidably mounted on said mobile body front end portion for movement along said predetermined straight-line path, a platform secured to said frame lower end portion for supporting an operator on said frame, a protective canopy secured to said frame upper end portion and positioned in overlying relation with said platform, said protective canopy having a front end portion for supporting said drill steel guide and a rear end portion extending in overlying relation with said mobile body, and extensible means mounted on said mobile body and connected to said protective canopy for raising and lowering said frame relative to said mobile body in a plane aligned with said predetermined straight-line path.

9. A mine drilling machine as set forth in claim 1 which includes, said operator's compartment having an upper end portion and a lower end portion, said lower end portion positioned adjacent to said mobile body front end portion, a support member secured to said mobile body front end portion, said support member having a guideway extending upwardly in a plane aligned with said predetermined straight-line path, a follower member secured to said operator's compartment lower end portion, and said follower member being movably positioned in said support member guideway so that said operator's compartment lower end portion moves in a plane aligned with said predetermined straight-line path.

10. A mine drilling machine as set forth in claim 1 which includes, stabilizing means secured to said mobile body front end portion for stabilizing said mobile body during drilling operations, said stabilizing means being extensible to move to a lowered position engaged with the ground and to a raised position disengaged from the ground, and said drill steel guide being secured to said operator's compartment in a position so that when said stabilizing means is in said lowered position said drill steel guide is positioned to maintain the drill steel in a vertical linear plane.

* * * * *